US007156132B2

(12) United States Patent
O'Dougherty et al.

(10) Patent No.: US 7,156,132 B2
(45) Date of Patent: Jan. 2, 2007

(54) COLLAPSIBLE FLUID CONTAINER

(75) Inventors: Kevin O'Dougherty, Arden Hills, MN (US); Robert Andrews, Hudson, MA (US); John Titus, Lonsdale, MN (US)

(73) Assignee: Advanced Technology Materials, Inc., Danbury, CT (US)

( * ) Notice: Subject to any disclaimer, the term of this patent is extended or adjusted under 35 U.S.C. 154(b) by 169 days.

(21) Appl. No.: 10/869,700

(22) Filed: Jun. 16, 2004

(65) Prior Publication Data

US 2005/0279421 A1 Dec. 22, 2005

(51) Int. Cl.
*B65B 1/04* (2006.01)

(52) U.S. Cl. ..... 141/114; 141/286; 222/94

(58) Field of Classification Search ..... 141/114, 141/313, 286, 10; 222/94
See application file for complete search history.

(56) References Cited

U.S. PATENT DOCUMENTS

| | | | | |
|---|---|---|---|---|
| 4,955,508 | A * | 9/1990 | Capanna et al. | 222/94 |
| 5,335,821 | A | 8/1994 | Osgar | |
| 5,435,460 | A | 7/1995 | Osgar | |
| 5,560,403 | A * | 10/1996 | Balteau et al. | 141/9 |
| 2003/0205285 | A1 | 11/2003 | Kelly et al. | |
| 2003/0205581 | A1 | 11/2003 | Wertenberger | |

* cited by examiner

*Primary Examiner*—Steven O. Douglas
(74) *Attorney, Agent, or Firm*—Kinney & Lange, P.A.

(57) ABSTRACT

The present invention is a collapsible fluid container for handling liquid. The collapsible fluid container has an interior volume for storing the liquid, which defines a main chamber and an auxiliary chamber connected to the main chamber. The auxiliary chamber is positioned to receive a substance. A fitment is sealed to the collapsible fluid container that defines a port communicating with the interior volume of the fluid container.

25 Claims, 6 Drawing Sheets

COLLAPSIBLE FLUID CONTAINER

CROSS-REFERENCE TO RELATED APPLICATION(S)

This application is related to a co-pending application filed on even date and entitled "Liquid Delivery System," which is incorporated herein by reference.

BACKGROUND OF THE INVENTION

The present invention relates generally to the field of fluid containers for use in industrial liquid delivery systems. In particular, the present invention relates to a fluid container that helps minimize the formation of gas microbubbles in liquid chemical streams.

In many industrial process applications, fluid containers are employed as a source of process liquids for liquid delivery systems. Oftentimes the fluid containers are fabricated and filled at locations remote from the end-use facility. In such situations, the end-use facility then either directly incorporates the fluid containers into a liquid delivery system or empties the liquid from the fluid containers into a reservoir connected to the liquid delivery system.

In certain industrial process applications, the presence of gas microbubbles in liquid traveling through a liquid delivery system may have harmful effects. For example, when liquids are deposited on a substrate to form a layer, the presence of microbubbles in the deposited liquids may cause defects in the deposited layer or subsequent deposited layers. Depending upon the pressure conditions in the fluid container and the liquid delivery system, the presence of headspace gas in the fluid container and/or the liquid delivery system may contribute to the formation of microbubbles in the liquid stream.

In the semiconductor industry, for example, a common manufacturing step in producing integrated circuits involves depositing photoresist solution on silicon wafers. The presence of microbubbles in the photoresist solution will typically yield defect sites on the surface of the wafer in subsequent process steps. As features on integrated circuits have continued to become smaller, the presence of microbubbles has posed an increasing danger to the quality of integrated circuits. Moreover, when microbubbles are observed in industrial liquid delivery systems, the systems are often purged until the microbubbles are eliminated, which can result in the wasting of expensive chemical liquids. Thus, it is advantageous to eliminate, or at least minimize, the presence of microbubbles in liquid delivery systems.

Given these problems associated with the formation of microbubbles, there is a need for a fluid container that removes headspace gas and helps reduce microbubble formation in liquid traveling through liquid delivery systems.

BRIEF SUMMARY OF THE INVENTION

The present invention is a collapsible fluid container for handling liquid that includes an interior volume for storing the liquid. The interior volume defines a main chamber and an auxiliary chamber. The main chamber is for dispensing liquid into the flow path of a liquid delivery system and the auxiliary chamber is for receiving a substance. A fitment is sealed to the fluid container and defines a port communicating with the interior volume of the fluid container.

While the above-identified drawing figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art which fall within the scope and spirit of the principles of the invention. The figures may not be drawn to scale. Like reference numbers have been used throughout the figures to denote like parts.

DETAILED DESCRIPTION

The elimination of headspace gas from fluid containers and flow paths of liquid delivery systems is important for inhibiting the formation of microbubbles in liquids traveling through the flow paths. As such, the present invention is directed to a fluid container capable of eliminating headspace gas from an interior volume of the fluid container and/or the flow path of a liquid delivery system. The present invention is further directed to a fluid container capable of receiving liquid and/or headspace gas from a flow path of a liquid delivery system, eliminating the need for a separate plumbed drain and allowing the liquid to be stored for later use.

It is well known that gas can dissolve in liquids in a physical manner, without chemical reactions or interactions. Gas that dissolves in liquid without undergoing chemical reactions or interactions may come out of solution and form microbubbles if the solubility of the gas in the liquid decreases. The total volume of gas that will dissolve in a liquid under equilibrium conditions depends upon the composition of the liquid, the composition of the gas, the partial pressure of the gas, and the temperature. If the composition of the liquid and the gas is fixed, and the temperature remains constant, the solubility of a gas in the liquid is directly proportional to the pressure of the gas above the surface of the liquid. Unless otherwise specified, the term "gas" is intended herein to include atmospheric air, as well as any other gas or combination of gases.

Figure 1:
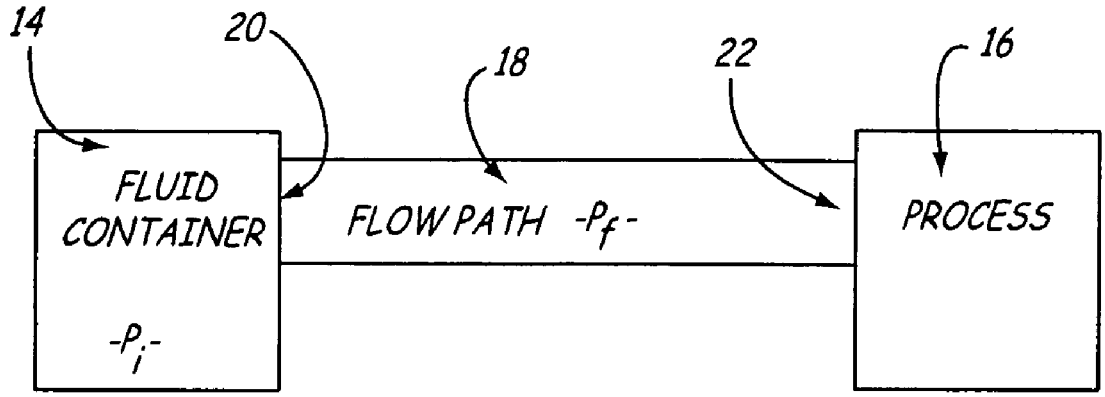
FIG. 1 is a block-diagram representation of a liquid delivery system.
Figure 2:
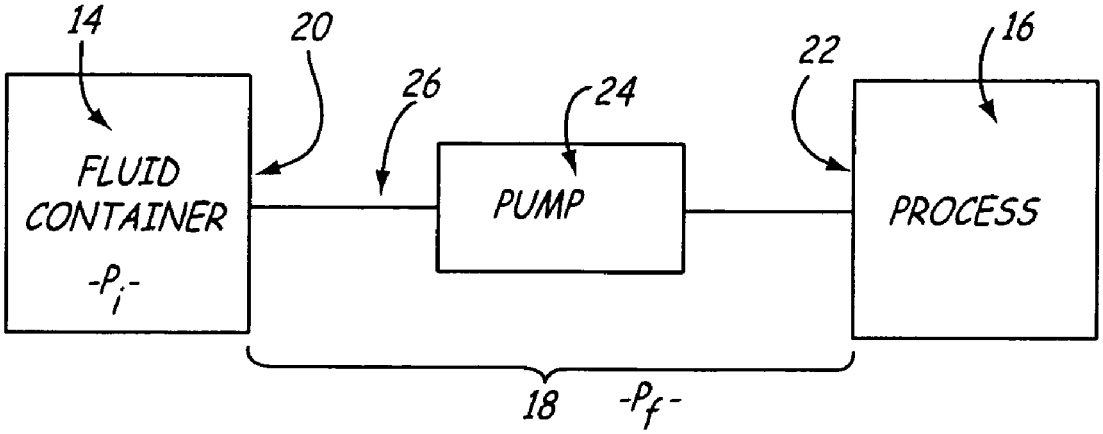
FIG. 2 is a block-diagram representation of the liquid delivery system of FIG. 1 including a pump.
Figure 3A:
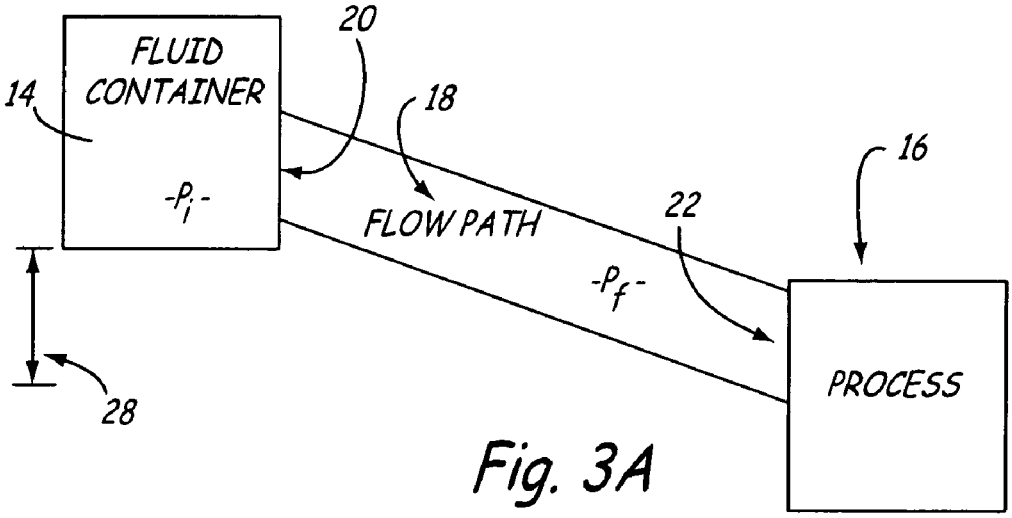
FIG. 3A is a block-diagram representation of the liquid delivery system of FIG. 1 including an elevated fluid container.
Figure 3B:
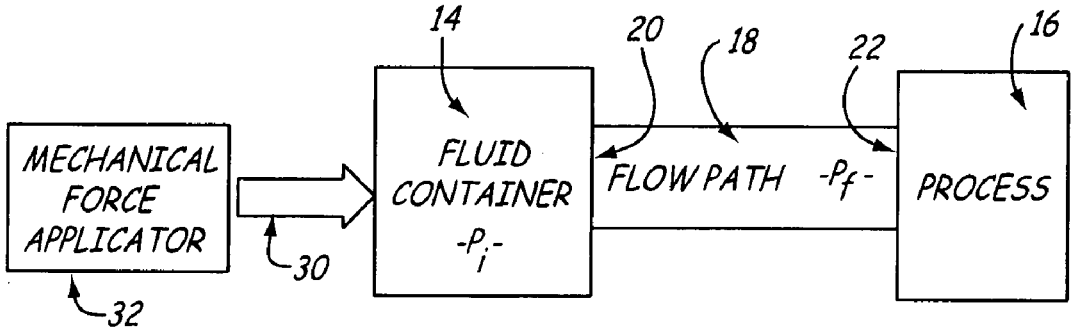
FIG. 3B is a block-diagram representation of the liquid delivery system of FIG. 1 including a mechanical force applicator.
Figure 3C:
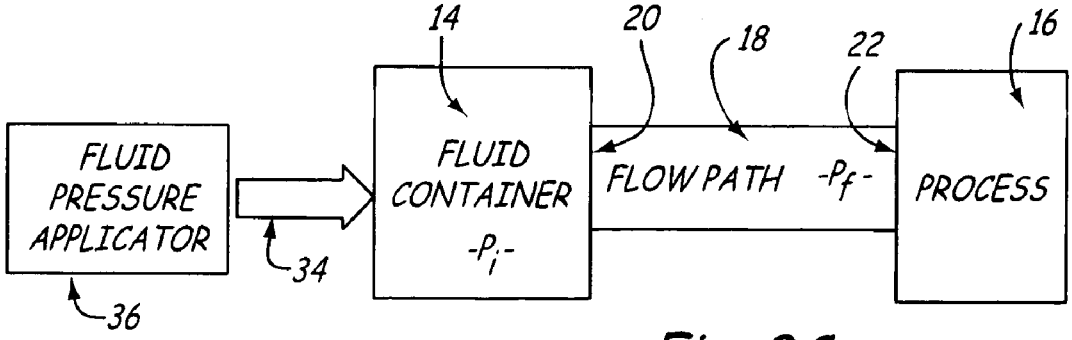
FIG. 3C is a block-diagram representation of the liquid delivery system of FIG. 1 including a fluid pressure applicator.

FIGS. 1–3C show block-diagram representations of liquid delivery systems for delivering liquid from a fluid container to a downstream process. FIGS. 1 and 2 are included to illustrate conditions in liquid delivery systems that contribute to microbubble formation. FIGS. 3A–3C are included to illustrate liquid delivery systems that inhibit microbubble formation. The term "microbubble" herein is intended to include both (1) gas bubbles that are perceivable to the human eye without magnification and (2) gas bubbles that are too small to be perceived without magnification or other detection means.

As shown in FIG. 1, a liquid delivery system includes a fluid container 14 that communicates with a downstream process 16 via a flow path 18. Liquid is supplied from fluid container 14 into an inlet end 20 of flow path 18 and delivered along flow path 18 to an outlet end 22 of flow path 18, which communicates with downstream process 16. The liquid in fluid container 14 has a volume of gas dissolved in it proportional to an equilibrated pressure, $P_{eq}$, which is the pressure under which gas is exposed to a liquid and becomes generally equilibrated with the liquid. Assuming the liquid is exposed to the gas at $P_{eq}$ for a sufficient period of time, the liquid becomes generally saturated with dissolved gas. In many industrial process applications, $P_{eq}$ will be equal to atmospheric pressure.

As shown in FIG. 1, the liquid in fluid container 14 is subjected to an initial pressure, $P_i$, inside fluid container 14. As the liquid enters inlet end 20 and flows through flow path 18 to outlet end 22, the liquid is subjected to a flow pressure, $P_f$, which represents the flow pressure at a given point in the flow path. $P_f$ varies along flow path 18 between inlet end 20 and outlet end 22 to form a pressure gradient that causes the liquid to flow from inlet end 20 to outlet end 22.

A drop in the pressure of a saturated liquid flowing through a liquid delivery system results in gas microbubbles forming in the liquid. In the liquid delivery system of FIG. 1, microbubble formation generally occurs in flow path 18 when $P_f$ falls below $P_{eq}$. A drop in pressure to less than $P_{eq}$ decreases the solubility of gas in the liquid, causing the liquid to become super-saturated, and thereby causing dissolved gas to come out of solution and form microbubbles. Thus, microbubble formation can be inhibited by maintaining the pressure of the liquid in the flow path at a level that is at least as high as the pressure at which the liquid became equilibrated with gas. That is, microbubble formation may be inhibited by maintaining $P_f$ at a level equal or greater than $P_{eq}$. In many industrial process applications, this means preventing the pressure of the liquid from falling below atmospheric pressure.

Liquid delivery systems may include a pump in the flow path to meter and/or assist the flow of liquid through the flow path. FIG. 2 is a block-diagram representation of the liquid delivery system of FIG. 1, in which flow path 14 includes a pump 24. In certain configurations of the liquid delivery system, pump 24 generally establishes a $P_f$ on suction-side 26 of flow path 18 that is less than $P_i$. For example, when fluid container 14 is located at an elevation lower than pump 24, or when sufficient friction is present within flow path 18, a $P_f$ less than $P_i$ must be established to cause liquid to flow along flow path 18 from fluid container 14 to pump 24. If in doing so, $P_f$ falls below $P_{eq}$, microbubbles may form in the liquid in flow path 18. Therefore, such microbubble formation may be inhibited by preventing $P_f$ from falling below $P_{eq}$. For additional discussion of microbubble formation in liquid delivery systems, see the co-pending application entitled "Liquid Delivery System," which is incorporated herein by reference.

FIGS. 3A–3C show different examples of the liquid delivery system of FIG. 1 that prevent $P_f$ from falling below $P_{eq}$. In FIG. 3A, fluid container 14 is elevated a distance 28, relative to flow path 18, to prevent $P_f$ from falling below $P_{eq}$. For example, in industrial process applications where $P_{eq}$ is equal to atmospheric pressure, elevating fluid container 14 by distance 28 prevents $P_f$ from generally falling below atmospheric pressure. By elevating the fluid container relative to the other parts of the liquid delivery system, a positive hydraulic head is created which acts as a buffer to absorb pressure decreases without the pressure reaching subatmospheric levels. Thus, microbubble formation may be inhibited by elevating the fluid container relative to the other parts of the liquid delivery system.

In many industrial process applications, it may not be practical to elevate the fluid container relative to the flow path of the liquid delivery system. The effects of positive hydraulic head, however, may be mimicked without actually elevating the fluid container by applying pressure to the liquid inside the fluid container to increase the pressure of the liquid. FIGS. 3B and 3C each illustrate a system for applying pressure to the liquid inside the fluid container to raise $P_i$ above $P_{eq}$ to prevent $P_f$ from falling below $P_{eq}$.

FIG. 3B shows a mechanical force 30 applied to fluid container 14 by a mechanical force applicator 32 to raise $P_i$ to simulate the effect of elevating fluid container 14. Examples of suitable mechanical force applicators include a piston or a plunger. FIG. 3C shows a fluid pressure 34 applied to fluid container 14 by a fluid pressure applicator 36 to raise $P_i$ to simulate the effect of elevating fluid container 14.

If headspace gas is present inside the fluid container when $P_i$ is made greater than $P_{eq}$, the increased pressure will drive additional gas into solution, and microbubble formation may occur if the pressure of the liquid subsequently falls below $P_i$. Thus, when $P_i$ is greater than $P_{eq}$, fluid container 14 should be substantially free of headspace gas to inhibit microbubble formation. A key feature of the fluid container of the present invention is the ability to remove headspace gas from an interior volume of a fluid container to inhibit subsequent microbubble formation.

Figure 4A:
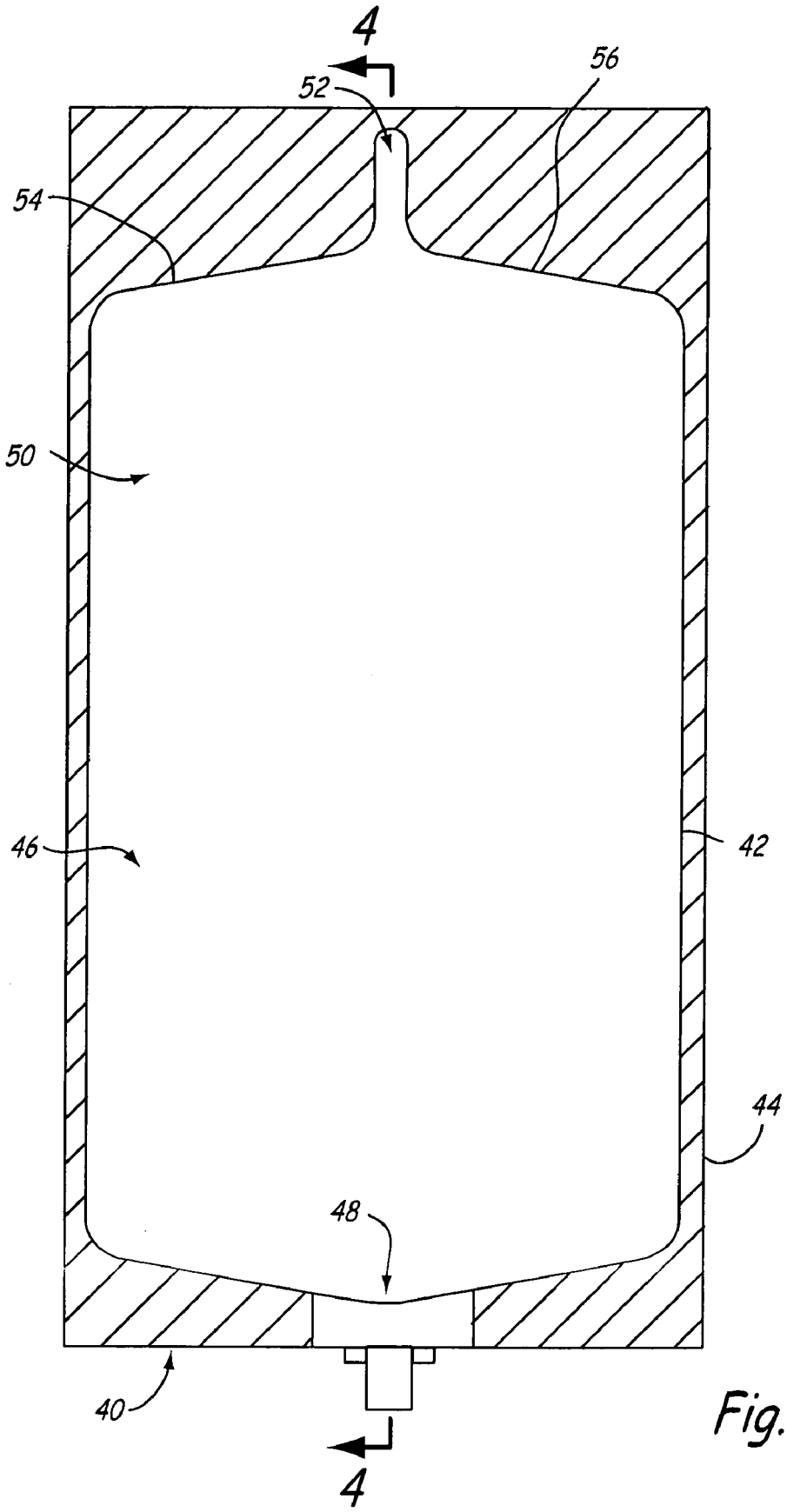
FIG. 4A is a front view of a collapsible liner equipped with a gas-trapping auxiliary chamber.
Figure 4B:
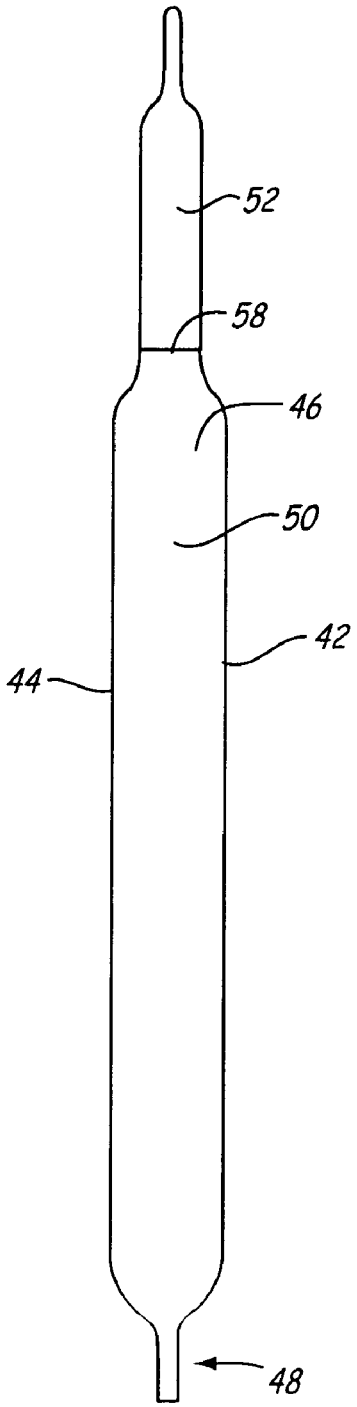
FIG. 4B is a cross-section taken along line 4—4 of FIG. 4A prior to sealing off the gas-trapping auxiliary chamber.
Figure 4C:
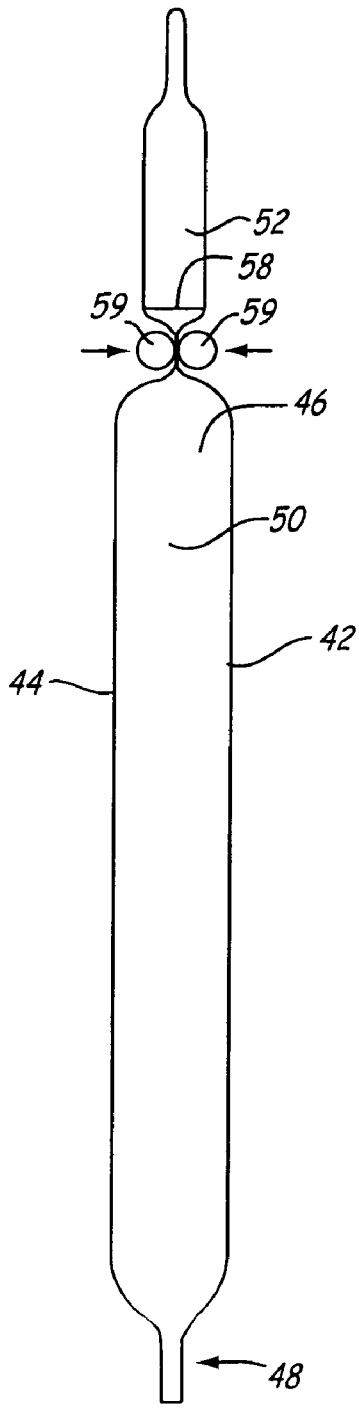
FIG. 4C is a cross-section taken along line 4—4 of FIG. 4A after sealing off the gas-trapping auxiliary chamber.

FIGS. 4A–4C show a collapsible liner of the present invention, with FIG. 4A showing a front view of a collapsible liner 40, FIG. 4B showing a cross-section taken along line 4—4 of FIG. 4A after filling collapsible liner 40 with liquid and prior to sealing off a gas-trapping auxiliary chamber, and FIG. 4C showing a cross-section taken along line 4—4 of FIG. 4A after filling collapsible liner 40 with liquid and sealing off the gas-trapping auxiliary chamber. Collapsible liner 40 may be used in a liquid delivery system as a fluid container or as a component of a fluid container.

Collapsible liner 40 has a top film 42 and a bottom film 44, which are sealed together to define an interior volume 46 for holding liquid. As shown in FIG. 4A, sealed together portions of films 42 and 44 are represented by hatched lines. Interior volume 46 has a main chamber 50 and a gas-trapping auxiliary chamber 52 connected to main chamber 50. Main chamber 50 has tapered walls 54 and 56, which taper towards auxiliary chamber 52.

A fitment 48 is sealed to collapsible liner 40 to define a port communicating with interior volume 46. Such a port may be used to supply liquid into interior volume 46. In addition, fitment 48 may be used to dispense liquid from interior volume 46 into a flow path, or alternatively, additional fitment may be included for such purposes. Moreover, fitment 48 may define a plurality of ports and may be located anywhere on the fluid container capable of communicating with interior volume 46. In other embodiments of the present invention, a plurality of fitments communicate with the interior volume of the fluid container. The fitment(s) may be of any design known in the art and may be located in any combination at any location on the fluid container.

Collapsible liner 40 may be formed by folding over a flexible sheet of material to form top film 42 and bottom film 44. In one embodiment, the sheet material is impermeable to gas. Examples of suitable materials include fluorinated polymers such as polytetrafluoroethylene ("PTFE") and perfluoroalkoxy ("PFA"), polyethylene, polyethylene with a nylon barrier layer(s), and combinations thereof. The peripheral portions of films 42 and 44 are sealed together to form interior volume 46. The shape of interior volume 46 is determined by the portions of films 42 and 44 that are sealed together. Films 42 and 44 may be sealed around the entire periphery where the two films meet or, alternatively, one or more regions of the periphery may be left unsealed to accommodate any number of fitments. In addition, any other suitable method of manufacture known in the art may be used to form collapsible liner 40. In one embodiment, films 42 and 44 of collapsible liner 40 are constructed from material that tends to stick tightly together, which discourages air from being trapped inside interior volume 46. The attraction of films 42 and 44 for one another may be accomplished, or enhanced, by imparting a static charge to the films to improve the attraction between the films and help exclude headspace gas from interior volume 46.

When a generally zero headspace condition is desired inside collapsible liner 40, interior volume 46 is first filled with a quantity of liquid sufficient to completely fill main chamber 50 with liquid. To achieve optical removal of headspace gas from main chamber 50, collapsible liner 40 should .be oriented vertically so auxiliary chamber 52 has the highest elevation and main chamber 50 has the lowest elevation. This orientation encourages headspace gas to congregate inside auxiliary chamber 52 so a gas/liquid interface 58 locates inside auxiliary chamber 52. Tapered walls 54 and 56 of main chamber 50 further encourage headspace gas to migrate towards auxiliary chamber 52. As shown in FIGS. 4B and 4C, after interface 58 is located inside auxiliary chamber 52 and main chamber 50 is generally devoid of headspace gas, auxiliary chamber 52 is sealed off from main chamber 50, thereby trapping the headspace gas within auxiliary chamber 52. To achieve maximum removal of headspace gas from main chamber 50, auxiliary chamber 52 is sealed off at a location below interface 58.

Auxiliary chamber 52 may be sealed using any suitable method known in the art. FIG. 4C shows an example of a pinch mechanism 59, which may be used to seal off auxiliary chamber 52 from main chamber 50.

Figure 5A:
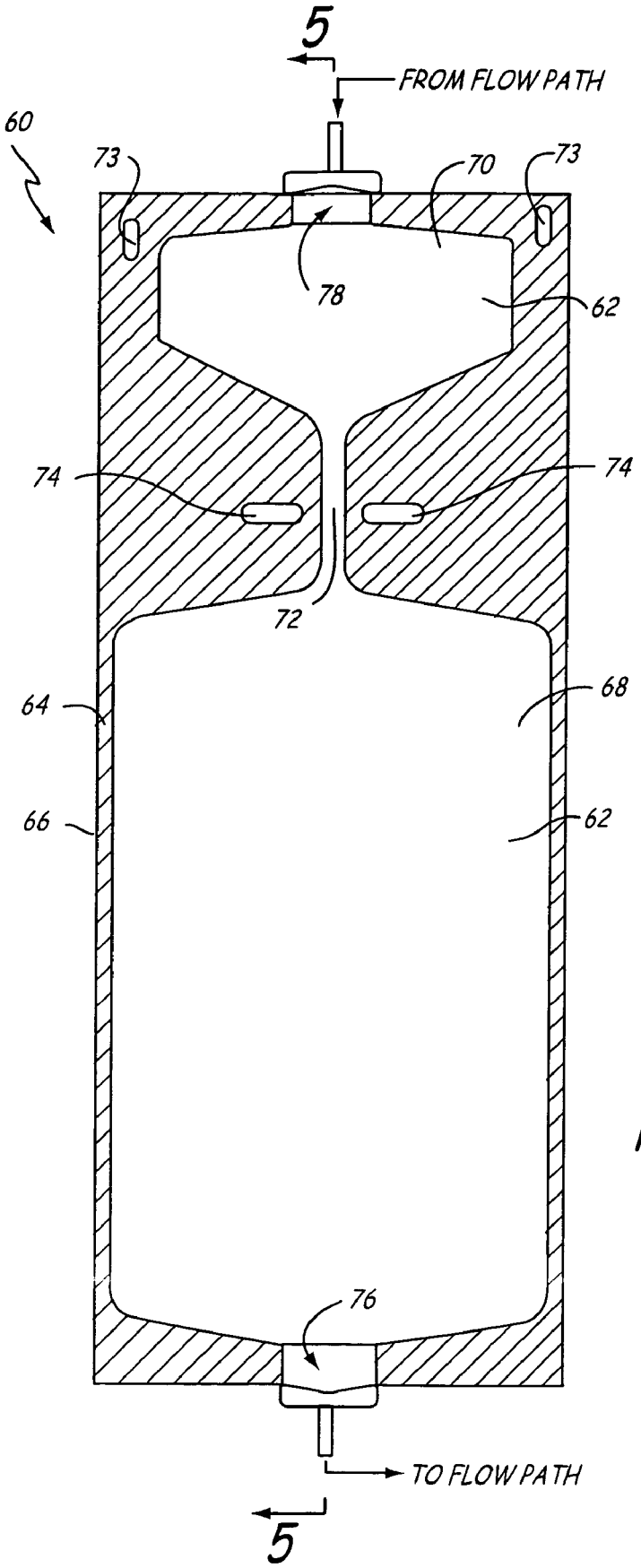
FIG. 5A is a front view of a collapsible liner having a dispensing chamber and a collection chamber.
Figure 5B:
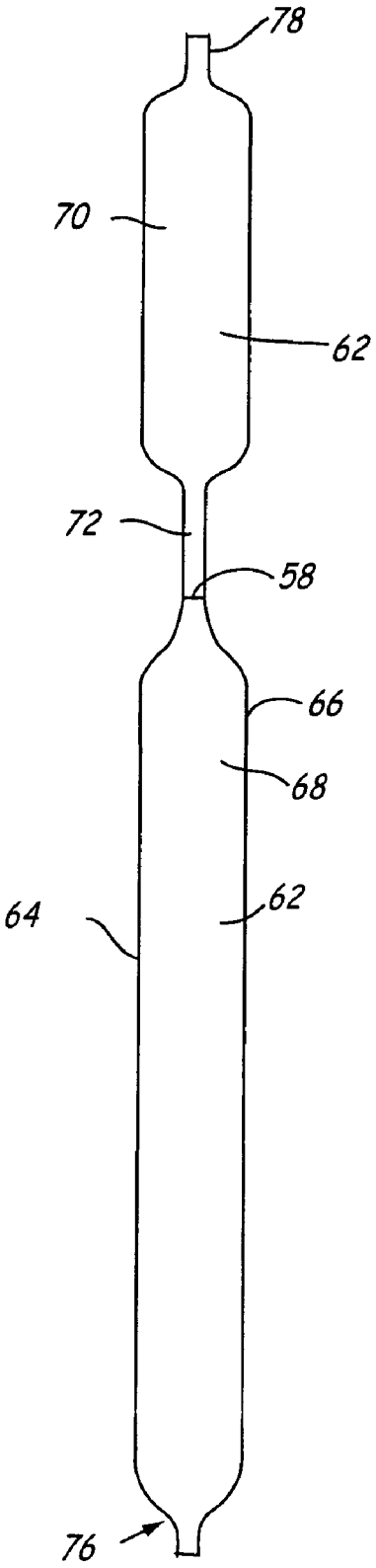
FIG. 5B is a cross-section taken along line 5—5 of FIG. 5A prior to sealing off the collection chamber.
Figure 5C:
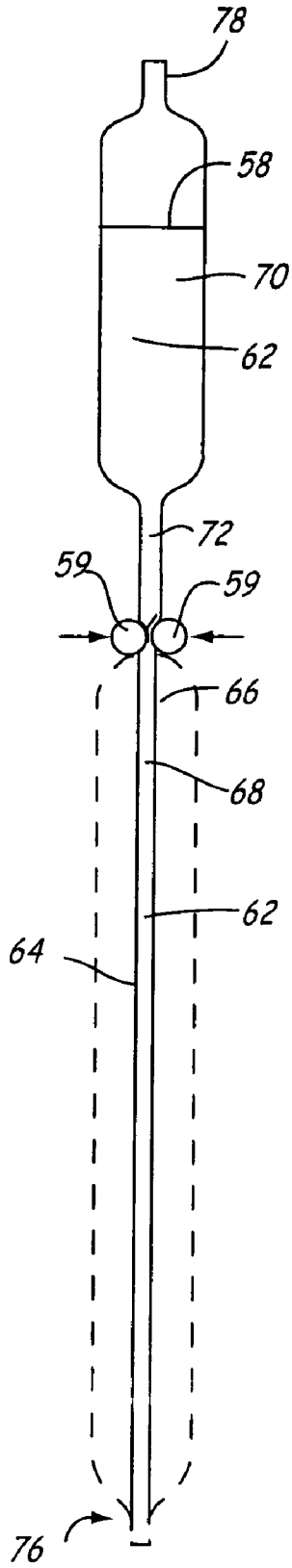
FIG. 5C is a cross-section taken along line 5—5 of FIG. 5A after sealing off the collection chamber.

FIGS. 5A–5C show another embodiment of the fluid container of the present invention, which allows liquid and/or headspace gas to be collected from an outlet of a flow path of a liquid delivery system. FIG. 5A shows a front view of a collapsible liner 60; FIG. 5B shows a cross-section of collapsible liner 60 taken along line 5—5 of FIG. 5A after filling a dispensing chamber with liquid and before sealing off a collection chamber; and FIG. 5C shows a cross-section of collapsible liner 60 taken along line 5—5 of FIG. 5A after sealing off the collection chamber, dispensing the liquid from the collection chamber, and collecting the liquid in the collection chamber. Like collapsible liner 40, collapsible liner 60 may be used as a fluid container for a liquid delivery system or as a component of such a fluid container.

Collapsible liner 60 has an interior volume 62 defined by a top film 64 and a bottom film 66 which are sealed together as represented by hatched lines in FIG. 5A. Interior volume 62 includes a dispensing chamber 68, a collection chamber 70, and a passage 72 connecting dispensing chamber 68 and collection chamber 70. In one embodiment, the walls of dispensing chamber 68 and collection chamber 70 are tapered towards passage 72. Hanging holes 73 may be formed in films 64 and 66 to receive supports to allow collapsible liner 60 to be vertically suspended.

Collapsible lines 60 may be formed pursuant to the methods described above for collapsible liner 40. Portions of films 64 and 66 may be sealed together to form interior volume 62, with the hatched lines in FIG. 5A representing the sealed together portions of films 64 and 66. The two films may be sealed around the entire periphery where the two films met or, alternatively, one or more regions of the periphery may be left unsealed to accommodate any number of fitments.

Similar to collapsible liner 40, collapsible liner 60 may be configured to achieve a zero headspace condition. Passage 72 may be sealed off to terminate communication between dispensing chamber 68 and collection chamber 70 and isolate headspace gas within collection chamber 70. A zero headspace condition may be obtained inside dispensing chamber 68 using the methods described above for collapsible liner 40. For example, as shown in FIG. 5B, collapsible liner 60 is filled and oriented so interface 58 between the liquid and the headspace gas is located within passage 72. Passage 72 is then pinched off below interface 58 similar to collapsible liner 40 in FIG. 4C. As such, collection chamber 70 may be used as a gas-trapping chamber similar to auxiliary chamber 52 of collapsible liner 40. In one embodiment, clamping holes 74 are provided in films 64 and 66 for insertion of a clamping device to seal off passage 72.

Fitments 76 and 78 are sealed to collapsible liner 60 to define ports communicating with interior volume 62. Fitment 76 is located at an end of dispensing chamber 68 opposite collection chamber 70, and fitment 78 is located at an end of collection chamber 70 opposite dispensing chamber 68. In other embodiments, any number of fitments having any number of ports may be sealed to collapsible liner 40 at any location(s) that provide access to interior volume 62.

Fitments 76 and 78 may be mated, respectively, with an inlet end of a flow path and an outlet end of a flow path, thereby placing each fitment in communication with the flow path. In this configuration, liquid in dispensing chamber 68 may be dispensed into the flow path and liquid from the flow path may be collected in collection chamber 70. FIG. 5C shows collapsible liner 60 with liquid collected in sealed off collection chamber 70 after liquid has been dispensed from dispensing chamber 68 into the flow path. The broken lines in FIG. 5C represent the cross-section of dispensing chamber 68 prior to dispensing the liquid into the flow path. The liquid collected in the collection chamber may be saved for later use or discarded. As such, the collection chamber may function as a storage reservoir or a waste reservoir. In particular, the collection chamber may be used to receive liquid used to purge headspace gas or other contaminants from the flow path.

The liquid collected in collection chamber 70 may be drained into dispensing chamber 68 by unsealing passage 72. In addition, the liquid may be allowed to equilibrate within collection chamber 70 before being drained back into dispensing chamber 68, thereby reducing the amount of dissolved gas in the liquid and discouraging microbubble formation.

Using the present invention, headspace gas can be removed from the liquid in a fluid container without venting any of the headspace gas to the surrounding environment. This feature of the present invention reduces the wasting of valuable liquid, which can occur when venting headspace gas from inside a fluid container, and provides a safe means for removing headspace gas from fluid containers holding toxic or caustic liquids.

Although the present invention has been described with reference to preferred embodiments, workers skilled in the art will recognize that changes may be made in form and detail without departing from the spirit and scope of the invention.

The invention claimed is:

1. A collapsible fluid container for handling liquid, the fluid container for connecting to a flow path of a liquid delivery system, the fluid container comprising:

an interior volume for storing the liquid, the interior volume defining a main chamber and an auxiliary chamber, the main chamber for dispensing liquid into the flow path and the auxiliary chamber for receiving a substance, the interior volume adapted to permit sealing off of the auxiliary chamber from the main chamber; and a fitment sealed to the fluid container, the fitment defining a port communicating with the interior volume of the fluid container.

2. The collapsible fluid container of claim 1, wherein the substance is headspace gas.

3. The collapsible fluid container of claim 1, wherein the substance is liquid from the flow path.

4. The collapsible fluid container of claim 1, wherein the main chamber and the auxiliary chamber are connected.

5. The collapsible fluid container of claim 4, wherein the auxiliary chamber is positioned relative to the main chamber to trap headspace gas.

6. The collapsible fluid container of claim 5, wherein the main chamber tapers towards the auxiliary chamber.

7. The collapsible fluid container of claim 4, wherein the auxiliary chamber tapers towards the main chamber.

8. The collapsible fluid container of claim 4, wherein a sealable passage connects the main chamber and the auxiliary chamber.

9. The collapsible fluid container of claim 1, wherein the interior volume is defined by a flexible liner.

10. The collapsible fluid container of claim 1, wherein the flexible linear is formed from a material impermeable to gas.

11. The collapsible fluid container of claim 1, wherein an outlet fitment is sealed to the fluid container to define a port that communicates with the main chamber of the interior volume and an inlet fitment is sealed to the fluid container to define a port that communicates with the auxiliary chamber of the interior volume.

12. The collapsible fluid container of claim 1, wherein the fluid container is for handling liquid to be used in processing microstructures.

13. A method for filling a fluid container with liquid to minimize headspace, the method comprising:

providing a fluid container for holding the liquid in an interior volume having a main chamber and an auxiliary chamber, the auxiliary chamber connected to the main chamber;

filling the interior volume of the fluid container with a quantity of liquid so that the main chamber contains the liquid and the auxiliary chamber contains headspace gas; and sealing off the auxiliary chamber from the main chamber so that the headspace gas is trapped in the auxiliary chamber.

14. The method of claim 13, wherein the interior volume is defined by a flexible liner.

15. The method of claim 14, wherein the flexible liner is impermeable to gas.

16. The method of claim 13, wherein the main chamber tapers towards the auxiliary chamber.

17. A method for collecting a substance from a flow path of a liquid delivery system, the method comprising:

providing a fluid container having a dispensing chamber and a collection chamber, the dispensing chamber holding a liquid;

connecting the dispensing chamber to an inlet end of the flow path;

connecting the collection chamber to an outlet end of the flow path;

sealing off the collection chamber from the dispensing chamber; and collecting a substance from the flow path in the collection chamber.

18. The method of claim 17, wherein the fluid container has a passage that connects the dispensing chamber and the collection chamber.

19. The method of claim 18, wherein sealing off the collection chamber from the dispensing chamber comprises sealing the passage between the dispensing chamber and the collection chamber to prevent the substance collected in the collection chamber from entering the dispensing chamber.

20. The method of claim 19, further comprising:

unsealing the passage to allow at least some of the substance collected in the collection chamber to enter the dispensing chamber.

21. The method of claim 17, wherein the substance is liquid from the flow path.

22. The method of claim 17 further comprising:

supplying the liquid from the dispensing chamber into the flow path of the liquid delivery system.

23. The method of claim 22 wherein sealing off the collection chamber from the dispensing chamber comprises:

removing headspace gas from the dispensing chamber of the fluid container before supplying the liquid into the flow path, wherein the headspace gas is removed from the dispensing chamber by sealing a passage between the dispensing chamber and the collection chamber so the headspace gas is trapped in the collection chamber.

24. A method of manufacturing a semiconductor device using the fluid container of claim 1 to dispense a material as part of the semiconductor manufacturing process.

25. The method of claim 24, wherein the material is a photoresist solution.

* * * * *